US005188011A

United States Patent [19]

Somal et al.

[11] Patent Number: 5,188,011

[45] Date of Patent: Feb. 23, 1993

[54] TEMPORARY COVER FOR THE SLICING KNIFE OF A SLICING MACHINE

[75] Inventors: Hardev S. Somal; Daniel Keehn, both of LaPorte, Ind.

[73] Assignee: Berkel Incorporated, LaPorte, Ind.

[21] Appl. No.: 716,533

[22] Filed: Jun. 17, 1991

[51] Int. Cl.[5] ..... B26D 7/22

[52] U.S. Cl. ..... 83/478; 83/545; 83/DIG. 1

[58] Field of Search ..... 83/478, 544, 545, 546, 83/DIG. 1

[56] References Cited

U.S. PATENT DOCUMENTS

| | | | |
|---|---|---|---|
| 745,516 | 12/1903 | Perks . | |
| 1,312,121 | 8/1919 | Johnson . | |
| 1,449,832 | 3/1923 | Nordin | 83/545 X |
| 1,687,729 | 10/1928 | Lucey . | |
| 1,728,843 | 9/1929 | Trunz . | |
| 2,052,366 | 8/1936 | Ahrndt et al. . | |
| 2,398,409 | 4/1946 | Carroll . | |
| 2,573,629 | 10/1951 | Klingens et al. . | |
| 2,573,860 | 11/1951 | Meeker et al. | 83/478 X |
| 2,619,142 | 11/1952 | Ditting | 83/478 |
| 2,728,367 | 12/1955 | Brown | 83/545 X |
| 2,781,067 | 2/1957 | Kaley . | |
| 3,171,236 | 3/1965 | DePaoli . | |
| 3,811,355 | 5/1974 | Cole | 83/520 |
| 3,821,918 | 7/1974 | Niehaus et al. | 83/471.3 |
| 3,841,184 | 10/1974 | Thatcher | 83/346 |
| 3,880,032 | 4/1975 | Green | 83/102.1 |
| 3,884,094 | 5/1975 | Ulmer . | |
| 3,913,437 | 10/1975 | Speer et al. | 83/478 |
| 4,070,941 | 1/1978 | Lorenz | 83/478 |
| 4,186,634 | 2/1980 | Akczinski, Sr. | 83/478 |
| 4,246,818 | 1/1981 | McGraw, Jr. | 83/478 |

FOREIGN PATENT DOCUMENTS

| | | | |
|---|---|---|---|
| 3013469 | 11/1981 | Fed. Rep. of Germany | 83/DIG. 1 |
| 2594375 | 8/1987 | France | 83/478 |

*Primary Examiner*—Eugenia Jones
*Attorney, Agent, or Firm*—Barnes & Thornburg

[57] ABSTRACT

A temporary cover for the slicing knife of a slicing machine which is preferably fabricated from a plastic material. The cover includes a substantially circular cover section having a flange extending from the peripheral edge of the cover section. The flange is dimensioned such that it surrounds and shields the cutting edge of the slicing knife from inadvertent contact. The cover further includes a retention pin and a spring-loaded retractable plunger which removably retains the cover to the slicing knife. Preferably, the cover also includes at least one handle which assists in installing and removing the cover from the slicing knife, as well as indicia for providing proper rotational orientation of the cover in relation to the slicing machine.

10 Claims, 1 Drawing Sheet

TEMPORARY COVER FOR THE SLICING KNIFE OF A SLICING MACHINE

BACKGROUND AND SUMMARY OF THE INVENTION

The present invention relates generally to a new and novel cover for the knife of a slicing machine. More particularly, the present invention relates to a temporary cover member which is capable of being readily mounted to the slicing knife of a commercial slicing machine, and which when so mounted surrounds and shields the peripheral cutting edge of the slicing knife from inadvertent contact.

Commercial slicing machines are widely utilized as a rapid and effective means of slicing meat, cheese, vegetables and other food products. Such machines commonly include a motor driven circular slicing knife having a cutting edge about its periphery and a means for passing a predetermined thickness of the food product to be sliced over the rotating slicing knife. During operation, those portions of the slicing knife not being utilized for slicing are normally shielded from inadvertent contact by a conventional operational guards. Such operational guards are shown, for example, in U.S. Pat. No. 2,573,860 to Meeker, et al. and U.S. Pat. No. 2,619,142 to Ditting.

In order to maintain clean and sanitary conditions, it is sometimes necessary to clean a slicing machine several times during the course of a day. To clean a slicing machine, it is normally necessary to remove the operational guards to permit access to the back side of the slicing knife. Also, when servicing a slicing machine, it is often necessary to remove the operational guards. When the operational guards are removed from a slicing machine, the entire cutting edge of the slicing knife is often exposed. Thus, individuals cleaning or servicing slicing machines in such a condition are exposed to potential injury if inadvertent contact is made with the cutting edge of the slicing knife.

The applicant is aware of two prior art devices for use in shielding the cutting edge of a slicing knife when the operational guards are removed. However, both of these devices have limitations which have limited their acceptance and effectiveness. U.S. Pat. No. 4,186,634 to Akezinski, Sr. discloses a slicing machine cleaning guard which consists of a cover element that extends beyond the cutting edge of the slicing blade throughout the entire circumference of the periphery of the slicing blade. In the embodiments disclosed in this patent, the rear surface of the cover element lies in contiguous and mating interface with the slicing blade front surface cutting section. Such a mating relationship between the guard and the slicing blade tends to dull the cutting edge of the slicer blade. In addition, food particles and/or moisture can become trapped between the guard and the slicing blade, thus resulting in an unsanitary condition. Furthermore, if a gap does develop between the guard and the slicing blade, the cutting edge can become exposed, thus creating a hazard of injury from inadvertent contact with the cutting edge.

U.S. Pat. No. 4,246,818 to McGraw, Jr. discloses a slicer knife safety cover which consists of a circular cover having a peripheral flange to overhang and enclose the cutting edge of the disk slicer knife. The circular cover is secured directly to the disk slicer knife by means of magnets. However, in practice, the use of magnets to secure a cutter guard to a disk slicing knife is often ineffective. To maintain sanitary conditions, disk slicing knives are often fabricated from a stainless steel material. However, stainless steels can have no, or limited magnetic properties. Therefore, safety guards secured by magnets can provide the individual cleaning and/or servicing the slicing machine a false sense of security. Such guards can be inadvertently displaced, thus limiting the extent of protection provided.

Accordingly, an object of the present invention is the provision of a temporary cover for the slicing knife of a slicing machine which is capable of being readily and securely attached to the slicing knife regardless of the magnetic characteristics of the material from which the slicing knife is fabricated.

Another object of the present invention is to provide a temporary cover for the slicing knife of a slicing machine which does not mate with the cutting section of the slicing knife, but yet is securely attached to the slicing knife, thus precluding inadvertent displacement from the slicing knife.

A further object of the present invention is to provide a temporary cover for the slicing knife of a slicing machine which, when installed on the slicing knife, permits air circulation between the cover and the slicing knife to allow any moisture present to evaporate in a timely manner.

A still further object of the present invention is to provide a temporary cover for the slicing knife of a slicing machine which is economical to produce, durable in construction, and capable of being quickly and easily installed on and removed from a disk slicing knife by an individual user.

These and other objects of the present invention are attained by the provision of a temporary cover for the slicing knife of a slicing machine which is preferably fabricated from a plastic material. The cover includes a substantially circular cover section having a flange extending from the peripheral edge of the cover section. The flange is dimensioned such that it surrounds and shields the cutting edge of the slicing knife from inadvertent contact. The cover further includes a retention pin and a spring-loaded retractable plunger which removably retains the cover to the slicing knife. Preferably, the cover also includes at least one handle which assists in installing and removing the cover from the slicing knife, as well as indicia for providing proper rotational orientation of the cover in relation to the slicing machine.

Other objects, advantages and novel features of the present invention will become apparent from the following detailed description of the invention when considered in conjunction with the accompanying drawings.

DETAILED DESCRIPTION OF THE DRAWINGS

Figure 1:
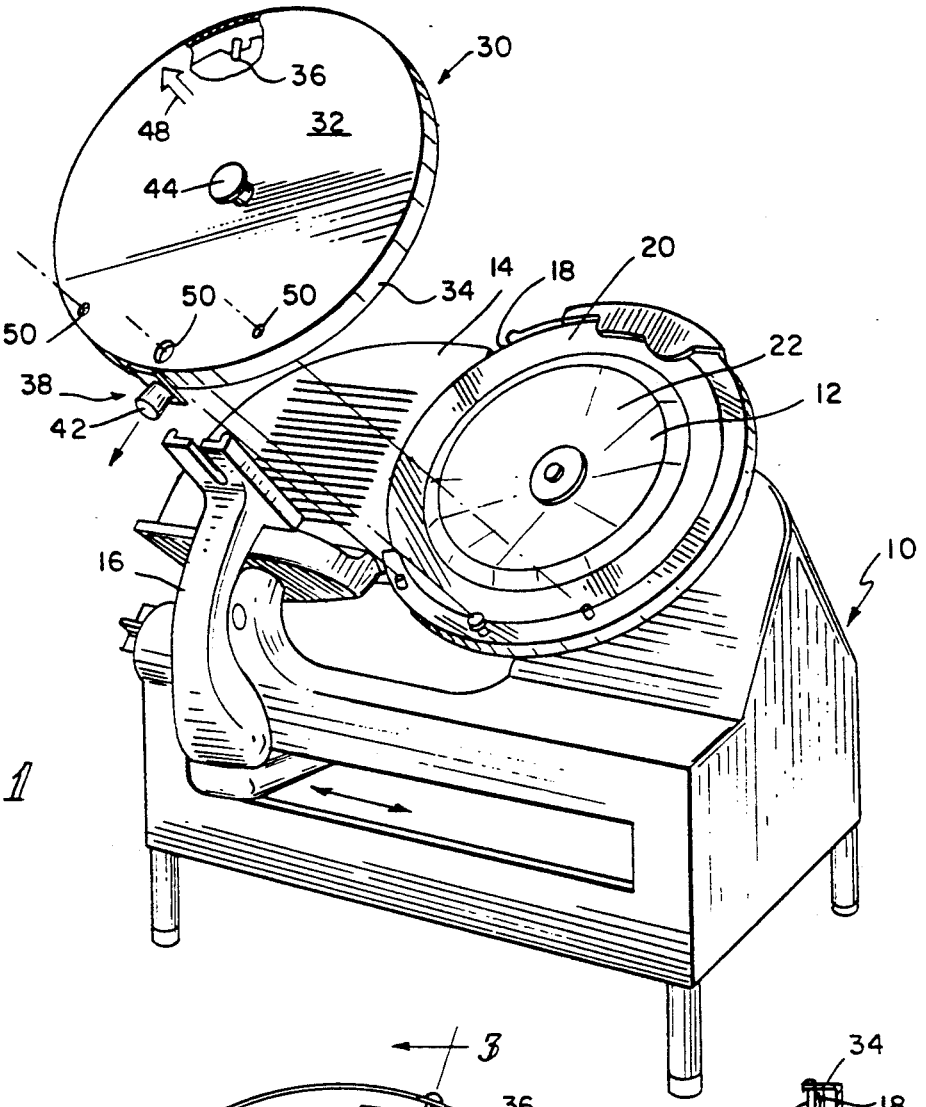
FIG. 1 is an exploded perspective view of a slicing machine with the operational guards removed to illustrate the exposed cutting edge of the slicing knife as would be the case when the slicing machine is to be cleaned or serviced and a cover according to the present invention positioned for installation onto the slicing knife.
Figure 2:
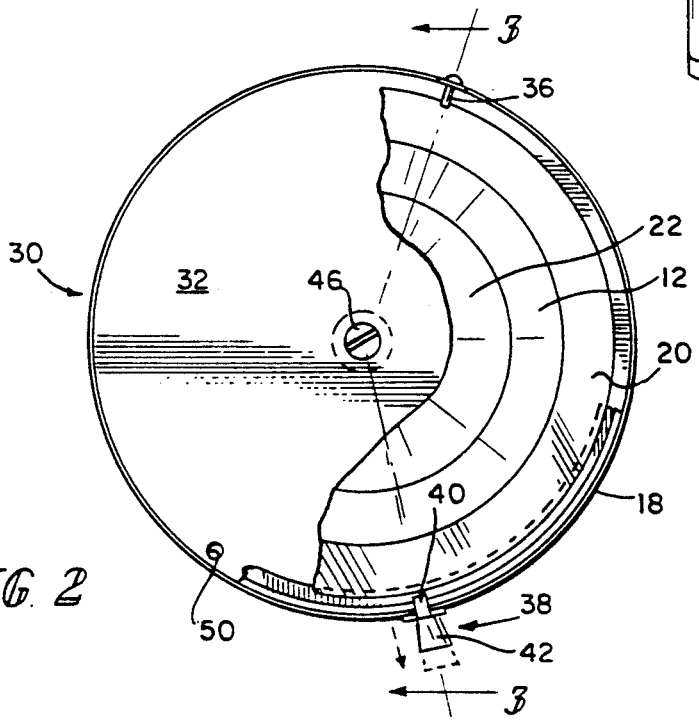
FIG. 2 is a rear view of the slicing knife and cover shown in FIG. 1 with portions of the slicing knife cut away for purposes of illustration.
Figure 3:
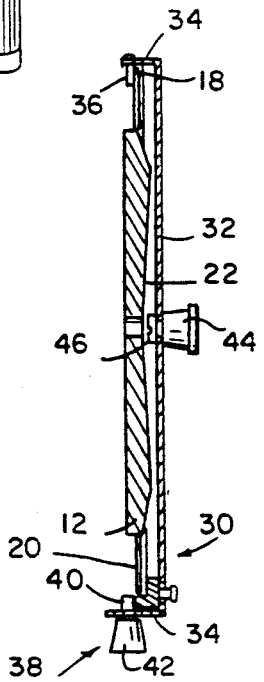
FIG. 3 is a cross-sectional side view of the slicing knife and cover shown in FIG. 1 taken across line 3—3 in FIG. 2.

Referring now to the drawings, in which like referenced characters indicate corresponding elements throughout the several views, attention is first directed to FIG. 1, which illustrates a preferred embodiment of a temporary cover designated generally by the number 30. Temporary cover 30 is used in conjunction with slicing machine 10 which is of conventional design. Slicing machine 10 generally includes circular slicing knife 12 which is rotated by means of a shaft (not shown) driven by an electric motor (not shown). Slicing machine 10 further includes adjustable plate 14 which supports the food to be sliced. Slidable carriage member 16, only a portion of which is shown, slides in relation to the peripheral edge of rotating slicing knife 12 to move the food product to be cut across slicing knife 12. Adjustable plate 14 is generally adjustable in relation to rotating slicing knife 12 to permit the food product to be cut into slices of differing thicknesses.

Slicing knife 12 includes at its peripheral circumference cutting edge 18. Cutting edge 18 transitions axially to cutting section 20 which extends inwardly from the peripheral cutting edge 18 for a distance of approximately one inch. Cutting section 20 transitions inwardly to recessed section 22 which is below cutting section 20. During operation, slicing machine 10 includes operational guards (not shown) which surround and shield the portions of cutting edge 18 which are not being utilized for slicing food products. However, during cleaning or servicing of slicing machine 10, it is often necessary to remove the operational guards. When the operational guards are removed, the entire circumference, or a significant portion of cutting edge 18 is exposed, thus presenting a hazard to individuals who clean, service, or otherwise have access to slicing machine 10 with the operational guards removed.

Temporary cover 30 is adapted to shield and preclude access to cutting edge 18 of slicing blade 12 when the operational guards are removed. Temporary cover 30 includes cover section 32 generally circular in configuration. Cover section 30 extends a radial distance greater than the diameter of slicing knife 12. At the peripheral edge of cover section 32, flange 34 extends substantially perpendicular to cover section 32. Cover section 32 and flange 34 are preferably fabricated as an integral plastic part. Most preferably, cover section 32 and flange 34 are fabricated from an acrylonitrile butadiene styrene (ABS) material, although other suitable materials may be utilized. The surface finish of temporary cover 30 can be textured, or smooth, as desired, although the smooth surface may be less likely to trap foreign particles, and thus easier to clean and maintain in a sanitary condition. In the preferred embodiment shown, the material thickness is approximately 0.090 inches.

Flange 34 preferably extends a sufficient distance from cover section 32 to shield cutting edge 18 when temporary cover 30 is installed on slicing knife 12. At a preselected position in flange 34, retention pin 36 extends radially inward from the interior surface of flange 34. Retention pin 36 is positioned such that cutting edge 18 of slicing knife 12 is retained between retention pin 36 and cover section 32. Retention pin 36 preferably consists of a threaded knurled cover pin or other suitable fastener attached to a #6×⅜" pan screw extending through an opening in flange 34 approximately 0.700 inches below the top surface of cover section 32, however, other suitable arrangements may be utilized.

At a position remote from retention pin 36, spring-loaded retractable plunger 38 is positioned in flange 34 extending radially inwardly from flange 34. Spring-loaded retractable plunger 38 is preferably located more than 90 degrees, more preferably more than the 120 degrees and most preferably approximately 180 degrees from retention pin 36. In the preferred embodiment shown, a spring-loaded plunger manufactured by Southco Inc. of Concordville, Pa., Vendor Part Number 56-99-259-20 is used, however, other alternate substitutions may be utilized. Spring-loaded retention plunger 38 includes inwardly extending plunger member 40 which is held in position by a spring. However, this spring force can be overcome, and plunger member 40 drawn outward by pulling on handle or knob assembly 42. Spring-loaded retractable plunger 38 is preferably secured to flange 34 at a position approximately 0.900 inches below the top surface of cover section 32.

In the preferred embodiment shown, handle 44 is positioned at substantially the centerpoint of cover section 32 and extends in a direction away from flange 34. Handle 44 is preferably secured in position by threaded fastener 46 extending through an opening in cover section 32 and engaging with handle 44.

In some preferred embodiments, indicia 48 is placed on the outer surface of cover section 32 to assist the user in positioning temporary cover 30 in the proper rotational orientation on slicing machine 10. Also, cut-outs 50 in cover section 32 and/or cut-outs (not shown) in flange 34 can be made to provide clearance for existing protrusions, or other obstructions in the vicinity of slicing knife 1 when the operational guards are removed. The size, number and positioning of these cut-outs can be readily modified to accommodate variations in slicing machine models.

To install temporary cover 30 onto slicing knife 12, the gage plate on slicing machine 10 is opened fully, and the sharpener assembly is removed or raised. Handle 44 of temporary cover 30 is then held with one hand, and handle or knob assembly 42 of spring-loaded retractable plunger 38 is pulled outwardly with the other hand. Once this is done, temporary cover 30 is placed over slicing knife 12 at an angle to engage retention pin 36 behind cutting edge 18 of slicing knife 12. With temporary cover 30 at the proper rotational orientation, and plunger 40 retracted, temporary cover 30 is lowered to a position where spring-loaded retractable plunger 38 is positioned behind cutting edge 18 of slicing knife 12. With temporary cover member 30 in this position, handle or knob assembly 42 of spring-loaded retractable plunger 38 is released and temporary cover 30 is securely retained to slicing knife 12 by cover section 32 above and retention pin 36 and plunger 40 below.

To remove temporary cover 30 from slicing knife 12, the above steps are reversed. Handle 44 of temporary cover 30 is held with one hand, and handle or knob assembly 42 of spring-loaded retractable plunger 38 is pulled outwardly with the other hand. When this is done, the side of temporary cover 30 having spring-loaded retractable plunger 38 is tilted upwardly. Temporary cover 30 is then moved laterally to clear retention pin 36 from slicing knife 12. At this time, temporary cover 30 is pulled away from slicing knife 12 and handle or knob assembly 42 released. The gage plate on slicing machine 10 is closed and the sharpener assembly lowered or reinstalled. Temporary cover 30 can then be cleaned and stored until again needed.

From the preceding description of the preferred embodiment, it is evident that the objects of the invention are attained by the present invention. Although this invention has been described and illustrated in detail, it is to be clearly understood that the same is by way of illustration and example only and is not to be taken by way of limitation. For example, some slicing machines have permanent slicing knife guards which remain in position after the operational guards are removed. A temporary cover according to the teachings of this invention could be readily utilized on such slicing machines by increasing the overall diameter of the temporary cover to extend over the permanent slicing knife guard and incorporating any necessary cut-outs to provide clearance for protruburances present on such slicing machines. Accordingly, the spirit and scope of this invention are to be limited only by the terms of the appended claims.

What is claimed is:

1. A cover for a slicing knife having a peripheral cutting edge, comprising:

a cover section having a radial dimension greater than said slicing knife;

a flange extending from a peripheral edge of said cover section about substantially the entire circumference of said cover section;

a non-magnetic attachment means for removably retaining said cover to said slicing knife;

wherein said flange extends below said peripheral cutting edge of said slicing knife when said cover is removably retained to said slicing knife;

said non-magnetic attachment means includes a retention pin inwardly extending from said flange, said retention pin is positioned to removably retain said peripheral cutting edge of said slicing knife between said cover section and said retention pin;

said non-magnetic attachment means includes a plunger inwardly extending from said flange, said plunger is positioned to removably retain said peripheral cutting edge of said slicing knife between said cover section and said plunger; and said plunger includes a spring which retains said plunger in said inwardly extending position and a handle which allows the force of said spring to be overcome and thus move said plunger to a second position radially outward of said inwardly extending position.

2. The cover of claim 1, wherein said retention pin and said plunger are separated on said flange by an angle greater than 90 degrees.

3. The cover of claim 1, wherein said retention pin and said plunger are substantially diametrically opposed.

4. The cover of claim 1, wherein said cover includes a handle extending from the side of said cover section opposite said flange.

5. The cover of claim 1, wherein said cover includes indicia which assists in indicating the proper rotational orientation of said cover in relation to said slicing knife.

6. The cover of claim 1, wherein said cover section and said flange are integrally fabricated from a plastic material.

7. The cover of claim 6, wherein said plastic material is acrylonitrile butadiene styrene.

8. A cover for a circular slicing knife having a peripheral cutting edge, comprising:

a substantially circular cover section having a diameter greater than said slicing knife;

a flange extending from a peripheral edge of said cover section about substantially the entire circumference of said cover section;

attachment means for removably retaining said cover on said slicing knife, said attachment means entering into a cavity behind said slicing knife to removably retain said cover to said slicing knife between said cover section and said attachment means;

wherein said flange extends below said peripheral cutting edge of said slicing knife when said cover is removably retained to said slicing knife;

said attachment means includes a retention pin inwardly extending from said flange, said retention pin is positioned to removably retain said peripheral cutting edge of said slicing knife between said cover section and said retention pin, and said attachment means includes a retractable plunger inwardly extending from said flange, said retractable plunger is positioned to removably retain said peripheral cutting edge of said slicing knife between said cover section and said retractable plunger; and said retractable plunger includes a spring which retains said retractable plunger in said inwardly extending position and a handle which allows the force of said spring to be overcome and thus move said retractable plunger to a second position radially outward of said inwardly extending position.

9. The cover of claim 8, wherein said retention pin and said retractable plunger are separated on said flange by an angle greater than 90 degrees.

10. The cover of claim 8, wherein said cover includes a handle extending from the side of said cover section opposite said flange.

* * * * *